United States Patent [19]

Katoh

[11] Patent Number: 4,800,150

[45] Date of Patent: Jan. 24, 1989

[54] SUPER-HIGH CONTRAST NEGATIVE TYPE PHOTOGRAPHIC MATERIAL

[75] Inventor: Kazunobu Katoh, Kanagawa, Japan

[73] Assignee: Fuji Photo Film Co., Ltd., Kanagawa, Japan

[21] Appl. No.: 33,699

[22] Filed: Apr. 3, 1987

[30] Foreign Application Priority Data

Apr. 3, 1986 [JP] Japan ..... 61-77323

[51] Int. Cl.[4] ..... G03C 1/33

[52] U.S. Cl. ..... 430/264; 430/949; 430/266; 430/267; 430/609

[58] Field of Search ..... 430/264, 949, 266, 267, 430/609

[56] References Cited

U.S. PATENT DOCUMENTS 4,243,739 1/1981 Mifune et al. ..... 430/564

4,332,878 6/1982 Akimura et al. ..... 430/448

*Primary Examiner*—Won H. Louie

*Attorney, Agent, or Firm*—Sughrue, Mion, Zinn, Macpeak & Seas

[57] ABSTRACT

A super-high contrast negative type silver halide photographic material is disclosed, comprising a support having provided thereon at least one silver halide emulsion layer, said emulsion layer or layers or other hydrophilic colloidal layer or layers containing a hydrazine derivative, wherein said material further contains an acidic polymer incorporating not less than 20 mol % of a monomer unit containing an acid group and a hydrophobic polymer incorporating not more than 20 mol % of a monomer unit containing an acid group and having a glass transition temperature of not more than 50° C. The material exhibits high contrast and high sensitivity without forming black spots even when processed with a stable developing solution.

23 Claims, No Drawings

SUPER-HIGH CONTRAST NEGATIVE TYPE PHOTOGRAPHIC MATERIAL

FIELD OF THE INVENTION

This invention relates to a silver halide photographic material and a method for forming a super-high contrast negative image using the same. More particularly, it relates to a silver halide photographic material useful for the photomechanical process and a method for forming a super-high contrast negative image using the same.

BACKGROUND OF THE INVENTION

In the field of graphic arts, in order to obtain satisfactory reproducibility of a dot image having a continuous graduation or a line image, an image formation system having super-high contrast photographic characteristics (particularly as having a gamma of not less than 10) is required.

For this purpose, a special developer referred to as lith developer has been conventionally employed. A lith developer contains hydroquinone as a developing agent, and, as a preservative, sulfite in the form of an adduct with formaldehyde, so as to have the free sulfite ion concentration controlled at an extremely low level, usually not more than 0.1 mol/l, in order not to inhibit infectious development. Therefore, the lith developer is extremely susceptible to air oxidation and does not withstand preservation for more than 3 days.

Use of hydrazine derivatives has been proposed for obtaining a high contrast with a stable developing solution, as disclosed in U.S. Pat. Nos. 4,224,401, 4,168,977, 4,166,742, 4,311,781, 4,272,606, 4,211,857, 4,243,739, etc. According to this technique, photographic characteristics of super-high contrast and high sensitivity can be achieved, and the stability of the developer to air-oxidation is markedly improved over earlier lith developers because addition of a sulfite to the developer at a high concentration is permissible.

However, the above-described image formation system with high sulfite condition brings about not only high sensitivity and high contrast, but also an unfavorable phenomenon of black spots, sometimes called black pepper, on non-developed areas between dots due to infection, which has presented a serious problem in photomechanical process. Formation of black spots frequently occurs when a light-sensitive material is preserved, particularly under a high temperature and high humidity condition, or when a developer undergoes fatigue with time, which generally involves decrease in sulfite ions used as preservative or increase in pH, resulting in considerable reduction of commercial value as a light-sensitive material for photomechanical process. Although many efforts have been made to overcome this problem, conventionally proposed techniques for eliminating black spots are often accompanied by reduction of sensitivity and gamma. Therefore, it has been keenly desired to develop a system free from black spots while retaining high sensitivity and high contrast.

It has proved effective for this purpose to lower the pH value of a film to 5.8 or less by adding an acidic substance as disclosed in Japanese Patent Applicaton (OPI) No. 228437/86 (the term "OPI" as used herein means a "published unexamined" Japanese Patent Application). Nevertheless, this technique is still unsatisfactory and is also found to cause another problem, particularly that the hydrazine derivative is precipitated in a coating composition before coating so that uniform activity of the hydrazine derivative cannot be obtained.

SUMMARY OF THE INVENTION

One object of the present invention is to provide a silver halide photographic material which exhibits high sensitivity and high contrast, having a gamma value exceeding 10, when processed with a stable developer, without forming black spots.

Another object of the present invention is to provide a silver halide photographic material which has a gamma value of 10 or more, does not form black spots, and can be prepared from a coating composition stable enough during the preparation.

It has now been found that the above objects can be accomplished by a super-high contrast negative type silver halide photographic material comprising a support having provided thereon at least one silver halide emulsion layer, said emulsion layer or layers or other hydrophilic colloidal layer or layers containing a hydrazine derivative, wherein said material further contains an acidic polymer incorporating not less than 20 mol% of a monomer unit containing an acid group and a hydrophobic polymer incorporating not more than 20 mol% of a monomer unit containing an acid group and having a glass transition temperature (Tg) of not more than 50° C.

DETAILED DESCRIPTION OF THE INVENTION

Hydrazine derivatives which can be used in the present invention include hydrazine derivatives having a sulfinyl group as described in U.S. Pat. No. 4,478,928 and compounds represented by formula (I) shown below.

Formula (I) is represented by $$R_1\text{—NHNH—CHO} \qquad \text{(I)}$$

wherein $R_1$ represents an aliphatic group, or an aromatic or heterocyclic group.

In formula (I), the aliphatic group as represented by $R_1$ is preferably a substituted or unsubstituted straight or branched chain or cyclic alkyl group having from 1 to 30 carbon atoms, and more preferably from 1 to 20 carbon atoms. The branched alkyl group may be cyclized to form a saturated hereto ring containing at least one hetero atom. The substituents for the alkyl group include an aryl group, an alkoxy group, a sulfoxy group, a sulfonamido group, a carbonamido group, etc.

Specific examples of the alkyl group for $R_1$ include a t-butyl group, an n-octyl group, a t-octyl group, a cyclohexyl group, a pyrrolidyl group, an imidazolyl group, a tetrahydrofuryl group, a morpholino group, etc.

The aromatic or heterocyclic group as represented by $R_1$ is a substituted or unsubstituted monocyclic or bicyclic aryl group or a substituted or unsubstituted unsaturated heterocyclic group. The unsaturated heterocyclic group may be condensed with a monocyclic or bicyclic aryl group to form a heteroaryl group. A particularly preferred group represented by $R_1$ in formula (I) is an aryl group.

Specific examples of the aromatic or heterocyclic group include a benzene ring, a naphthalene ring, a pyridine ring, a pyrimidine ring, an imidazole ring, a pyrrazole ring, a quinoline ring, an isoquinoline ring, a benzimidazole ring, a thiazole ring, a benzothiazole ring, etc. Of these, those containing a benzene ring are preferred. The aryl group, or aromatic or heterocyclic group represented by $R_1$ may have one or more substituents.

Typical substituents for the aromatic or heterocyclic group include a straight or branched chain or cyclic alkyl group (preferably having from 1 to 20 carbon atoms), an aralkyl group (preferably comprising a monocyclic or bicyclic aryl moiety and an alkyl moiety having from 1 to 3 carbon atoms), an alkoxy group (preferably having from 1 to 20 carbon atoms), a substituted amino group (preferably substituted by an alkyl group having from 1 to 20 atoms), an acylamino group (preferably having from 2 to 30 carbon atoms), a sulfonamido group (preferably having from 1 to 30 carbon atoms), a ureido group (preferably having from 1 to 30 carbon atoms), and the like. A particularly preferred examples of substituents is an acylamino group, a sulfonamide group, or a ureido group.

The aliphatic, or aromatic or heterocyclic group as represented by $R_1$ may have incorporated herein a ballast group commonly employed in immobile photographic additives, such as couplers. The ballast group is selected from those groups that contain 8 or more carbon atoms and are relatively inert to photographic characteristics, such as an alkyl group, an alkoxy group, a phenyl group, an alkylphenyl group, a phenoxy group, an alkylphenoxy group, and the like.

The aliphatic, or aromatic or heterocyclic group as represented by $R_1$ may further have incorporated therein a group enhancing adsorption onto surface of silver halide grains. Such an adsorptive group includes a thiourea group, a heterocyclic thioamido group, a mercapto heterocyclic group, a triazole group, etc., as described in U.S. Pat. No. 4,385,108.

Methods of synthesizing the compounds of formula (I) are described, e.g., in U.S. Pat. Nos. 4,168,977, 4,224,401, 4,171,977, and 4,323,643.

The hydrazine derivative which can be used in the present invention is preferably incorporated in a silver halide emulsion layer, but may be incorporated in any other light-insensitive hydrophilic colloidal layers, such as a protective layer, an interlayer, a filter layer, an anti-halation layer, and the like. Incorporation of the compound (I) can be carried out by dissolving it in water in case of using a water-soluble compound or in a water-miscible organic solvent, e.g., alcohols, esters, ketones, etc., in case of using a sparingly water soluble compound, and adding the solution to a hydrophilic colloid solution. When it is added to a silver halide emulsion layer, addition may be effected at any stage of from the commencement of chemical ripening up to the stage immediately before coating, and preferably from the end of chemical ripening to the stage before coating. In particular, the compound is preferably added to a coating composition ready to be coated.

The amount of the compound of formula (I) to be added is desirably selected so as to obtain best results according to the grain size and halogen composition of silver halides, the method and degree of chemical sensitization, the relation between the layer to which the compound is added and a silver halide emulsion layer, the kind of antifoggant used, and the like. Such selection is conventional for one skilled in the art. Usually, the compound of formula (I) is preferably used in an amount of from $1\times10^{-6}$ to $1\times10^{-1}$ mol, and more preferably from $1\times10^{-5}$ to $4\times10^{-2}$ mol, per mol of silver halide.

Specific but non-limitative examples of the compounds represented by formula (I) are shown below.

I-1

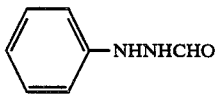

I-2

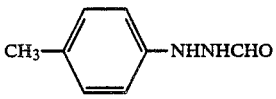

I-3

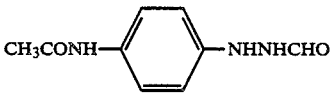

I-4

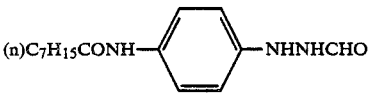

I-5

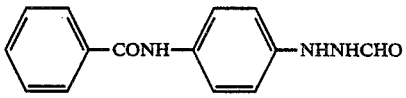

I-6

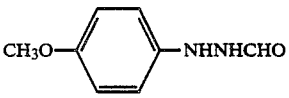

I-7

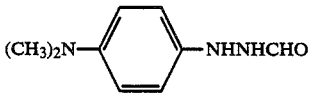

I-8

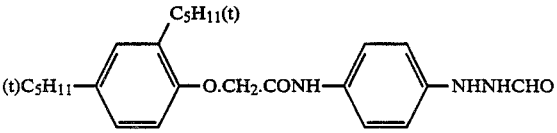

I-9

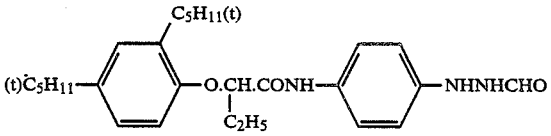

I-10

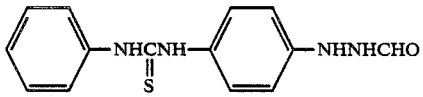

-continued
I-11
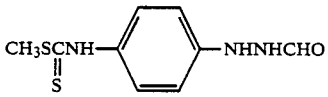
I-12
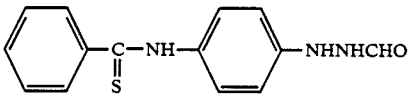
I-13
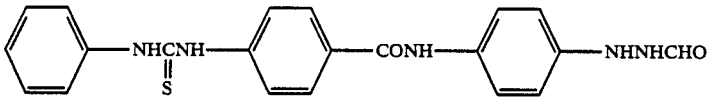
I-14
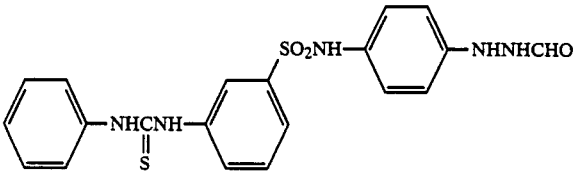
I-15
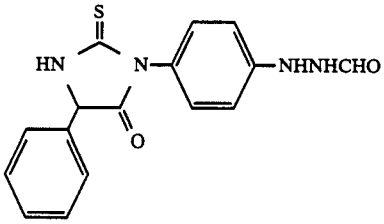
I-16
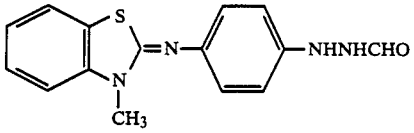
I-17
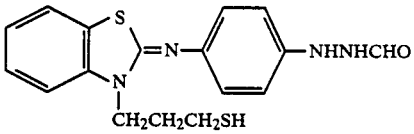
I-18
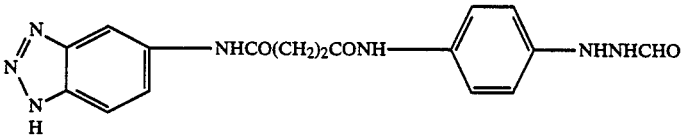
I-19
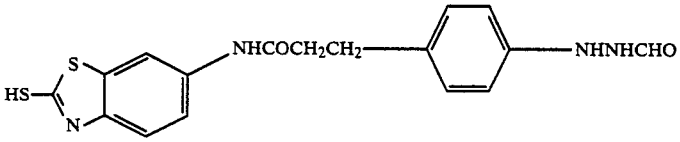
I-20
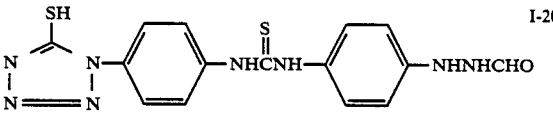
I-21
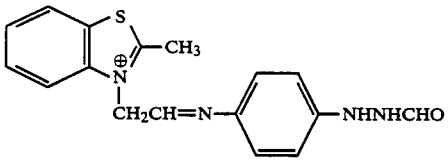
I-22
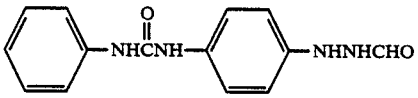
I-23
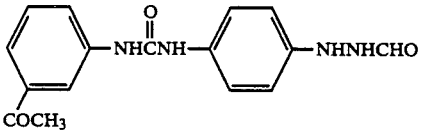
I-24
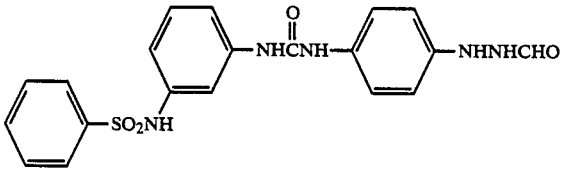
I-25
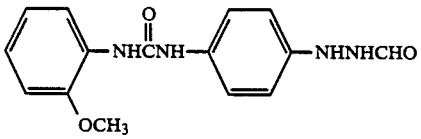
I-26
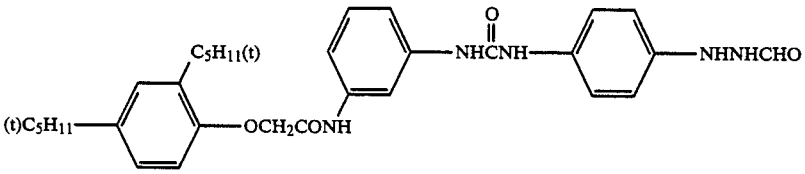

-continued

I-27

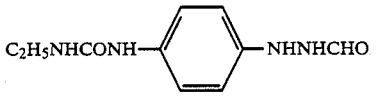

I-28

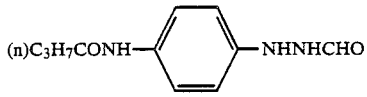

I-29

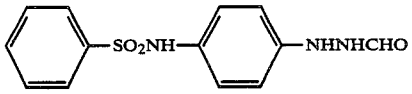

I-30

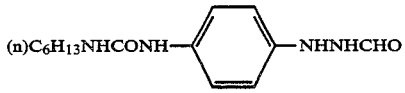

I-31

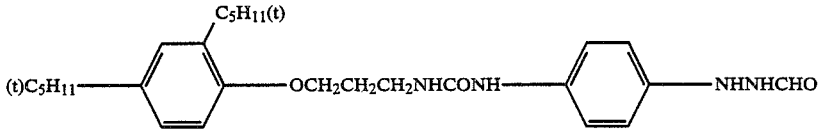

I-32

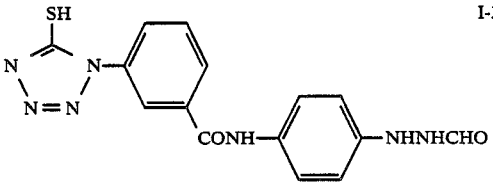

I-33

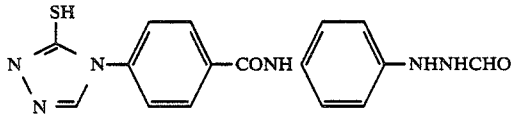

*PTS⊖: para-toluene sulfonate ion

In addition, compounds disclosed in U.S. Pat. No. 4,478,928, such as those shown below, may also be used.

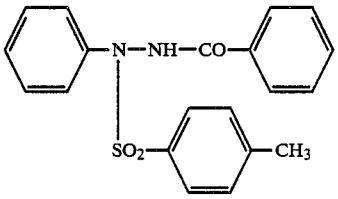

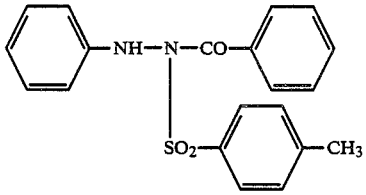

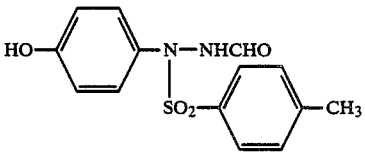

The acidic polymer which can be used in the present invention incorporates not less than 20 mol% of a monomer unit containing an acid group having a pKa value of 9 or smaller, and preferably a carboxyl group, a sulfoxylic acid group, or a phosphoric acid group. It is particularly preferable that the acidic polymer be used in the form of an aqueous polymer latex because such a polymer latex produces an interaction with gelatin to suppress flocculation or sedimentation of polymer particles.

The acidic polymer latex which can be used preferably in the present invention and a process for producing the same will be described in detail.

Copolymerizable ethylenically unsaturated monomers containing at least one acid group which can be used as a monomer unit for obtaining the acidic polymer of the invention include carboxylic acid monomers represented by formula (II)

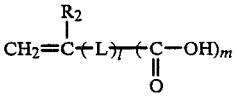

(II)

wherein $R_2$ represents a hydrogen atom or a substituted or unsubstituted alkyl group; L represents a di- to tetravalent linking group; l represents 0 or 1; and m represents 1, 2, or 3.

In formula (II), $R_2$ specifically represents a hydrogen atom, an unsubstituted alkyl group, e.g., a methyl group, an ethyl group, an n-propyl group, etc., or a substituted alkyl group, e.g., a carboxymethyl group, etc. Preferred among them are a hydrogen atom, a methyl group, and a carboxymethyl group.

L preferably represents —Q—,

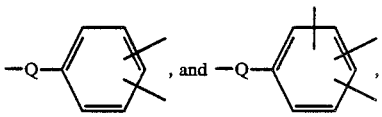

wherein Q represents a divalent linking group. Examples of the divalent linking group as represented by —Q— are an alkylene group (e.g., a methylene group, an ethylene group, a trimethylene group, etc.), an arylene group (e.g., a phenylene group, etc.), $$-\underset{\underset{O}{\|}}{C}-O-X_0-,$$

wherein $X_0$ represents an alkylene group having from 1 to about 6 carbon atoms or an arylene group (hereinafter the same)

(e.g., $-\underset{\underset{O}{\|}}{C}-OCH_2CH_2-$), $-\underset{\underset{O}{\|}}{C}-O-X_0-O-\underset{\underset{O}{\|}}{C}-$ (e.g.,

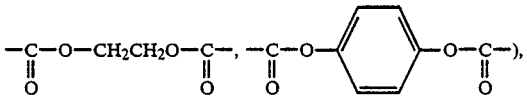

$-O-\underset{\underset{O}{\|}}{C}-X_0-$ (e.g., $-O-\underset{\underset{O}{\|}}{C}-CH_2CH_2-$), $-O-\underset{\underset{O}{\|}}{C}-X_0-\underset{\underset{O}{\|}}{C}-O-$ (e.g., $-O-\underset{\underset{O}{\|}}{C}-CH_2CH_2CH_2CH_2-\underset{\underset{O}{\|}}{C}-O-$), $-O-\underset{\underset{O}{\|}}{C}-NH-X_0-$ (e.g., $-\underset{\underset{O}{\|}}{C}-NH-$ 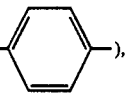 ), $-\underset{\underset{O}{\|}}{C}-NH-X_0-NH-\underset{\underset{O}{\|}}{C}-$ (e.g., $-\underset{\underset{O}{\|}}{C}-NH-CH_2CH_2NH\underset{\underset{O}{\|}}{C}-$, etc.), $-\underset{\underset{O}{\|}}{C}-NH-X_0-O-\underset{\underset{O}{\|}}{C}-$ (e.g., $-\underset{\underset{O}{\|}}{C}-NHCH_2CH_2O\underset{\underset{O}{\|}}{C}-$), and the like.

Specific but non-limitative examples of the carboxylic acid monomers of formula (II) are shown below.

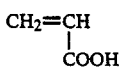

M-1

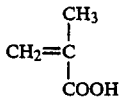

M-2

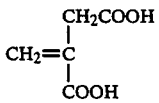

M-3

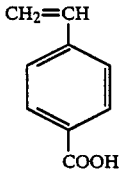

M-4

-continued

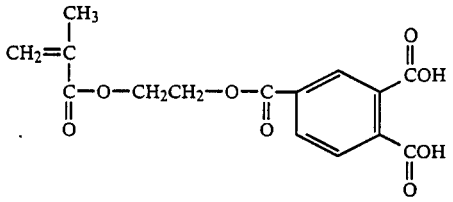

M-5

Additional examples of the ethylenically unsaturated monomers having at least one acid group include those capable of forming a carboxyl group upon contact with a developer, such as carboxylic acid anhydrides, lactone rings, etc.; monomers having a phenolic hydroxyl group; and monomers having a phosphoric acid group or sulfonic acid group as described in Japanese Patent Application (OPI) No. 128335/79.

In addition to the above-described monomers containing an acid group, the acidic polymer which can be used as a monomer unit in the present invention further comprises to advantage a crosslinkable monomer containing at least two copolymerizable ethylenically unsaturated groups (hereinafter referred to as crosslinkable monomer). Examples of such a crosslinkable monomer include divinylbenzene, ethylene glycol diacrylate, ethylene glycol dimethacrylate, diethylene glycol diacrylate, diethylene glycol dimethacrylate, triethylene glycol diacrylate, triethylene glycol dimethacrylate, trivinylcyclohexane, trimethylolpropane triacrylate, trimethylolpropane trimethacrylate, pentaerythritol triacrylate, pentaerythritol trimethacylate, pentaerythritol tetraacrylate, pentaerythritol tetramethacrylate, and the like. Of these, ethylene glycol dimethacrylate, divinylbenzene, pentaerythritol tetraacrylate, and pentaerythritol tetramethacrlate are particularly preferred.

The acidic polymer of the invention preferably incorporates from 20 to 90 mol%, and more preferably from 50 to 90 mol%, of the monomer having an acid group and from 1 to 50 mol%, and more preferably from 10 to 30 mol%, of the crosslinkable monomer.

For the purpose of producing combined functions, the acidic polymer of the invention may further comprise other copolymerizable ethylenically unsaturated monomer as a third monomer unit. Examples of such a monomer include ethylene, propylene, 1-butene, isobutene, styrene, α-methylstyrene, vinyltoluene, ethylenically unsaturated esters of fatty acids (e.g., vinyl acetate, allyl acetate, etc.), esters of ethylenically unsaturated carboxylic acids (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate, etc.), monoethylenically unsaturated compounds (e.g., acrylonitrile, methacrylonitrile, etc.), dienes (e.g., butadiene, isoprene, etc.), and the like. A copolymerization ratio of the third monomer unit is up to 50 mol%, and preferably up to 20 mol%.

In the polymerization of these monomers, any of known polymerization initiators recited in literatures relating to high polymer synthesis, e.g., T. Otsu and M. Kinoshita, *Kobunshi Gosei no Jikkenho,* Vol. 5, Kagakudojin, pages 130–131. Use of a water-soluble initiator is particularly preferred in the present invention. Known water-soluble polymerization initiators include persulfates and azo compounds. For use in the present invention, persulfates, such as potassium persulfate, particularly bring about good results. The amount of the polymerization initiator to be used generally ranges from 0.05 to 5% by weight, and preferably from 0.1 to 1.0% by weight, based on monomers.

Since the resulting acidic polymer possesses electric charges and is dispersed in water relatively stably, addition of a surface active agent to a water medium is not needed in most cases, but the dispersion stability may be ensured by auxiliarily adding a surface active agent. Specific but non-limitative examples of the surface active agent which can be used are shown below.

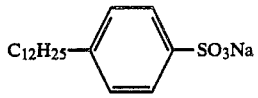

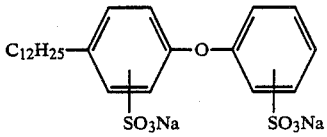

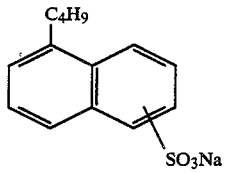

$C_{12}H_{25}OSO_3Na$ $C_{16}H_{33}OCOCH_2$
|
$C_{16}H_{33}OCOCHSO_3Na$ $C_2H_5$
|
$C_4H_9CHCH_2OCOCH_2$
|
$C_4H_9CHCH_2OCOCHSO_3Na$
|
$C_2H_5$

The acidic polymer latices which can be used preferably in the present invention can be obtained by simultaneously adding monomers and a polymerization initiator to water heated.

The polymerization temperature is one of the most important conditions for the polymerization process according to the present invention. In general, polymerization is carried out at temperatures between 50° C. and 80° C. Since the polymerization under such a temperature condition by-produces a large amount of agglomerates that are neither dispersed nor dissolved in water or organic solvents, it is difficult to obtain a good coating composition without removing the agglomerates. That is, such being the case, the formed agglomerates should be removed completely to obtain a coating film having satisfactory surface properties. It would be easily imagined that removal of the agglomerates incurs cost therefor and brings about reduction in yield, resulting in increase of overall cost of products.

In the present invention, the higher the polymerization temperature, the better. Considering the limitations of polymerization in water, the polymerization temperature usually ranges from 90° to 98° C. It is also possible to employ higher temperatures by designing a polymerization apparatus to that effect. After the polymerization reaction, it is preferable that a part of the resulting acidic polymer is neutralized with an alkali to such an extent that up to 30 mol%, and preferably from 3 to 20 mol%, of the polymer is in the form of a salt.

In cases where the acidic polymer according to the present invention is used in negative type silver halide photographic materials contaiing a hydrazine derivative, it is preferable that the polymer be used in the form of a polymer latex and the polymer latex be adjusted to a pH of from 3.5 to 5.0 by addition of an alkali.

The acidic polymer of the invention can also be prepared by reverse phase emulsion polymerization or a process comprising polymerization followed by hydrolysis with an acid or an alkali, to form an acid group.

Specific but non-limitative examples of the acidic polymer in accordance with the present invention are shown below. All the copolymerization ratios shown are by mol%.

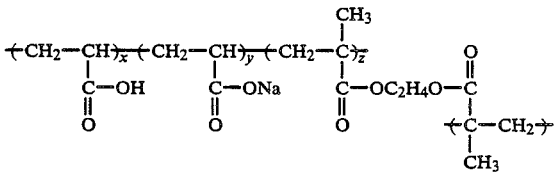

x/y/z = 64/9/27 (mole %, hereinafter the same)

II-1

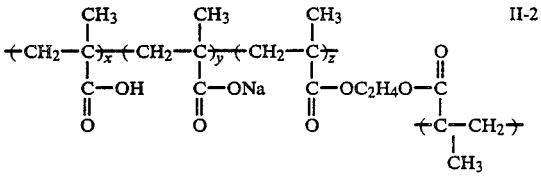

II-2 x/y/z = 60/15/25

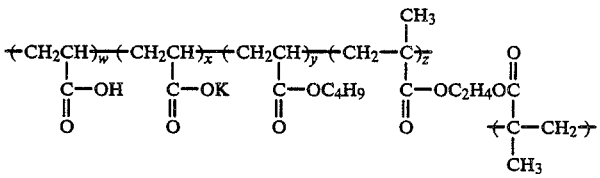

w/x/y/z = 67/10/13/10

II-3

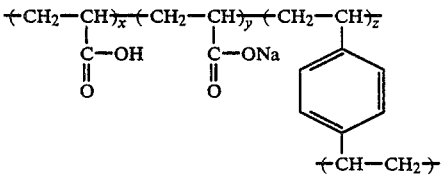

II-4 x/y/z = 60/10/30

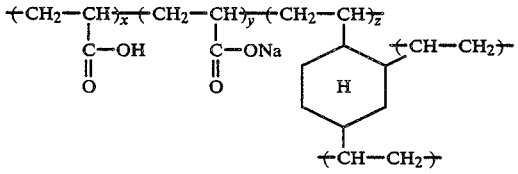

II-5 x/y/z = 72/13/15

-continued

II-6

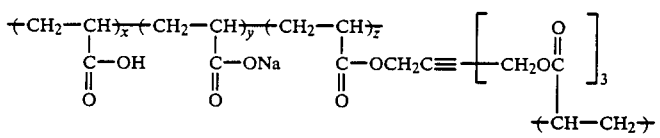

x/y/x = 68/12/20

II-7

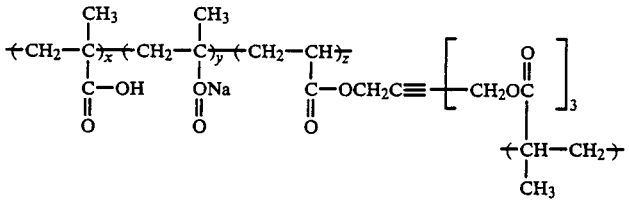

x/y/z = 69/11/20

II-8

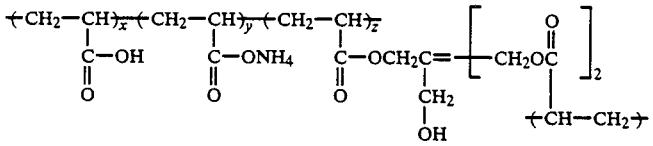

x/y/z = 50/35/15

II-9

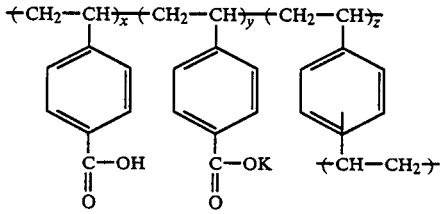

x/y/z = 64/11/25

II-10

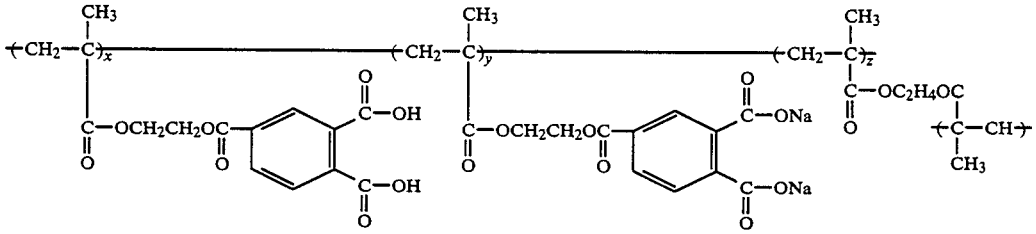

x/y/z = 60/10/30

II-11

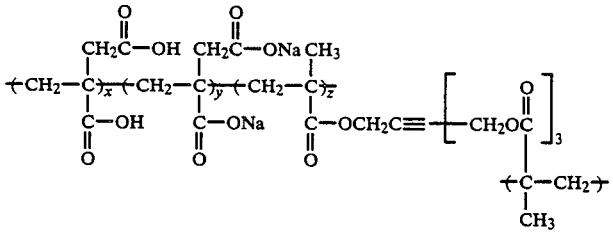

x/y/z = 70/15/15

The hydrophobic polymer incorporating not more than 20 mol% of a monomer unit having an acid group and having a glass transition temperature (Tg) of not more than 50° C. which can be used in the present invention is selected from homopolymers of various ethylenically unsaturated monomers and copolymers of such monomers and other copolymerizable monomers.

The ethylenically unsaturated monomers which can be used preferably are represented by formula (III)

(III)

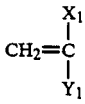

wherein $X_1$ represents a hydrogen atom, a halogen atom, a cyano group, or a substituted or unsubstituted alkyl group; and $Y_1$ represents a hydrogen atom, a halogen atom, a cyano group, a substituted or unsubstituted alkyl group, $$-\underset{\underset{O}{\|}}{C}-O-R_3,$$

wherein $R_3$ represents a substituted or unsubstituted alkyl group or a substituted or unsubstituted aryl group, $$-O-\underset{\underset{O}{\|}}{C}-R_4,$$

wherein $R_4$ represents a substituted or unsubstituted alkyl group or a substituted or unsubstituted aryl group, $$-\underset{\underset{O}{\|}}{C}-\overset{\overset{R_5}{|}}{N}-R_6,\ -\overset{\overset{R_5}{|}}{N}-\underset{\underset{O}{\|}}{C}-R_6,$$

wherein $R_5$ and $R_6$ (which may be the same or different) each represents a hydrogen atom, a substituted or unsubstituted alkyl group, or a substituted or unsubstituted aryl group.

Substituents for these alkyl or aryl groups include a hydroxyl group, a halogen atom (preferably a chlorine atom), a cyano group, an alkyl group, an aryl group, etc.

In formula (III), $X_1$ preferably represents a hydrogen atom or a substituted or unsubstituted alkyl group having from 1 to 4 carbon atoms, and $Y_1$ preferably represents $$-\underset{\underset{O}{\|}}{C}-O-R_3,$$

wherein $R_3$ represents a substituted or unsubstituted alkyl group, $$-O-\underset{\underset{O}{\|}}{C}-R_4,$$

wherein $R_4$ represents a substituted or unsubstituted alkyl group, $$-\underset{\underset{O}{\|}}{C}-\overset{\overset{R_5}{|}}{N}-R_6,\ -\overset{\overset{R_5}{|}}{N}-\underset{\underset{O}{\|}}{C}-R_6,$$

wherein $R_5$ and $R_6$ (which may be the same or different) each represents a hydrogen atom or a substituted or unsubstituted alkyl group, or a styryl group.

Most preferred for $Y_1$ are $$-\underset{\underset{O}{\|}}{C}-O-R_3,$$

wherein $R_3$ represents a substituted or unsubstituted alkyl group having from 2 to 6, and preferably from 3 to 5, carbon atoms, and $$-O-\underset{\underset{O}{\|}}{C}-R_4,$$

wherein $R_4$ represents a substituted or unsubstituted alkyl group having from 1 to 6 carbon atoms.

Monomers which are copolymerizable with the compound of formula (III) include a wider range of ethylenically unsaturated monomers having higher Tg, such as acrylic esters, methacrylic esters, acrylamides, styrene compounds, vinyl chloride compounds, vinyl ethers, alkenes, acrylonitrile compounds, and the like. The hydrophobic polymer may further comprise polyfunctional crosslinkable comonomers (i.e., crosslinkable monomers as described above) as recited with reference to the monomers of formula (II).

In addition to the monomers of formula (III), vinylidene chloride may also be used as a monomer for the hydrophobic polymer of the present invention.

Preferred examples of the monomer units derived from the compounds of formula (III) are shown below together with Tg values of polymers obtained therefrom. Tg values of (III-18) to (III-22) were calculated based on copolymerized monomer units.

| | | Tg (°C.) |
|---|---|---|
| (III-1) | $\leftarrow CH_2\underset{\underset{COOC_2H_5}{\vert}}{CH}\rightarrow$ | −22 |
| (III-2) | $\leftarrow CH_2\underset{\underset{COOCH_3}{\vert}}{CH}\rightarrow$ | 3 |
| (III-3) | $\leftarrow CH_2\underset{\underset{COOC_4H_9}{\vert}}{CH}\rightarrow$ | −56 |
| (III-4) | $\leftarrow CH_2\overset{\overset{CH_3}{\vert}}{\underset{\underset{COOC_4H_9}{\vert}}{C}}\rightarrow$ | 21 |
| (III-5) | $\leftarrow CH_2\underset{\underset{OCOCH_3}{\vert}}{CH}\rightarrow$ | 32 |

-continued

| | | Tg (°C.) |
|---|---|---|
| (III-6) | $\leftarrow CH_2CH \rightarrow$ (C₂H₅) | −24 |
| (III-7) | $\leftarrow CH_2CH \rightarrow$ ($COOCH_2C_6H_5$) | 6 |
| (III-8) | $\leftarrow CH_2CH \rightarrow$ ($isoC_6H_{13}$) | −34 |
| (III-9) | $\leftarrow CH_2CH \rightarrow$ ($COOC_4H_8CN$) | −40 |
| (III-10) | $\leftarrow CH_2CH \rightarrow$ ($COOC_2H_4CN$) | 4 |
| (III-11) | $\leftarrow CH_2CH \rightarrow$ ($COOCH_2CN$) | 23 |
| (III-12) | $\leftarrow CH_2CH \rightarrow$ ($COOC_2H_4OC_2H_5$) | −50 |
| (III-13) | $\leftarrow CH_2CH \rightarrow$ ($COOC_4H_8OCH_3$) | −56 |
| (III-14) | $\leftarrow CH_2CH \rightarrow$ ($CONHC_4H_9$) | 46 |
| (III-15) | $\leftarrow CH_2C(CH_3) \rightarrow$ ($COOC_6H_{13}$) | −5 |
| (III-16) | $\leftarrow CH_2CH \rightarrow$ ($OCH_3$) | −31 |
| (III-17) | $\leftarrow CH_2CH \rightarrow$ (C₆H₄–$C_6H_{13}$) | −27 |
| (III-18) | $\leftarrow CH_2CH \rightarrow_x$ ($COOCH_3$) $\leftarrow CH_2CH \rightarrow_y$ ($CONH$–$C(CH_3)_2$–$CH_2SO_3Na$) $\leftarrow CH_2CH \rightarrow_z$ ($COOC_2H_4OCO$–$CH_2COCH_3$)<br>x/y/z = 85/10/5 (mol %, hereinafter the same) | about 4 |
| (III-19) | $\leftarrow CH_2CH \rightarrow_w$ (C₆H₄) $\leftarrow CH_2CH \rightarrow_x$ ($COOC_4H_9$) $\leftarrow CH_2CH \rightarrow_y$ ($COOH$) $\leftarrow CH_2CH \rightarrow_z$ ($CONHCH_2O$)<br>w/x/y/z = 52/42/2/4 | about 21 |
| (III-20) | $\leftarrow CH_2CH \rightarrow_x$ ($COOCH_3$) $\leftarrow CH_2CH \rightarrow_y$ ($CONHCH_2SO_3Na$)<br>x/y = 94/6 | about 5 |

-continued

| | | Tg (°C.) |
|---|---|---|
| (III-21) | $\leftarrow CH_2CH\rangle_x$ ($COOCH_3$) $\leftarrow CH_2CH\rangle_y$ ($COOC_2H_4OCOCH_2COCH_3$)<br>x/y = 90/10 | about 1 |
| (III-22) | $\leftarrow CH_2CH\rangle_w$ ($CONHC_4H_9$) $\leftarrow CH_2CH\rangle_x$ (C6H5) $\leftarrow CH_2CH\rangle_y$ ($COOC_4H_9$) $\leftarrow CH_2CH\rangle_z$ (COONa)<br>w/x/y/z = 30/30/30/10 | about 15 |
| (III-23) | $\leftarrow CH_2CH\rangle_{97}$ ($COOC_2H_5$) $\leftarrow CH_2-CH\rangle_3$ (COOH) | −21 |

These hydrophobic polymer latices can be obtained as finely dispersed aqueous latices by well-known processes, such as emulsion polymerization or suspension polymerization.

The acidic polymer latex is used in an amount of from 0.05 to 2.0 g/m$^2$, and preferably from 0.1 to 1.0 g/m$^2$, and the hydrophobic polymer latex is used in an amount of from 0.1 to 3.0 g/m$^2$, and preferably from 0.2 to 1.5 g/m$^2$.

Silver halide emulsions which can be used in the present invention may have any halogen composition, including silver chloride, silver chlorobromide, silver iodobromide, silver iodochlorobromide, etc. Silver halide grains containing not more than 10 mol%, and particularly from 0.1 to 5 mol%, of silver iodide are preferred.

The silver halide grains to be used preferably have a small mean diameter (e.g., not more than 0.7 μm), and preferably a diameter of not more than 0.5 μm. A grain size distribution is not essentially critical, but monodisperse emulsions having narrow size distribution are preferred. The terminology "monodisperse" as used herein means that at least 95% of total weight or number of silver halide grains is included in the size range within ±40% of the mean grain size.

The silver halide grains may have a regular crystal form, such as cubic, octahedral, etc., an irregular crystal form, e.g., spherical, tabular, etc., or may have a composite crystal form thereof.

The silver halide grains may have a homogeneous phase throughout the individual grains or a heterogeneous phase having a core-shell structure. Two or more silver halide emulsions separately prepared may be used as a mixture. Silver halide emulsions differing in halogen composition may be coated in separate layers (upper and lower layers).

Two or more silver halide emulsions to be used may differ from each other in mean grain size, degree of chemical sensitization hereinafter described, halogen composition, crystal habit, amount of an iridium salt contained, and the like.

In the course of grain formation or physical ripening, a cadmium salt, a sulfite, a lead salt, a thallium salt, a rhodium salt or a complex salt thereof, an iridium salt or a complex salt thereof, etc., may be present in the system, as described in G. F. Duffin, *Photographic Emulsion Chemistry,* The Focal Press (1966).

Silver halides that are particularly suitable for use in the present invention are silver haloiodides whose silver iodide content in the surface portion thereof being greater than the average silver iodide content, which are prepared in the presence of an iridium salt or a complex salt thereof in an amount of from $1\times10^{-8}$ to $1\times10^{-5}$ mol per mol of silver. Use of emulsions containing such silver haloiodides ensures improvements on sensitivity and gamma.

In the preparation of aforesaid haloiodide emulsions, the iridium salt or iridium complex salt of the recited amount is preferably added before completion of physical ripening, and more preferably during grain formation. The iridium salt or complex thereof to be used should be water-soluble and includes iridium trichloride, iridium tetrachloride, potassium hexachloroiridate (III), potassium hexachloroiridate (IV), ammonium hexachloroiridate (III), etc.

Binders or protective colloids for photographic emulsions include gelatin to advantage and, in addition, other hydrophilic colloids, such as proteins, e.g., gelatin derivatives, grafted polymers of gelatin and other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a wide variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., or copolymers comprising monomers constituting these homopolymers.

Gelatin to be used includes not only lime-processed gelatin, but also acid-processed gelatin, hydrolysis products of gelatin, and enzymatic decomposition products of gelatin.

The silver halide emulsions to be used in the invention may or may not be subjected to chemical sensitization. Chemical sensitization can be carried out by any of sulfur sensitization, reduction sensitization, nobel metal sensitization, and combinations thereof. These methods are described in H. Frieser ed., *Die Grundlagen der Photographischen Prozesse mit Silberhalogeniden,* Akademische Verlagsgesellschaft (1968).

Sulfur sensitization is effected by using sulfur compounds contained in gelatin and other various sulfur compounds, such as thiosulfates, thioureas, thiazoles, rhodanines, etc. Reduction sensitization is effected by using a reducing agent, such as stannous salts, amines, formamidinesulfinic acid, silane compounds, etc. Nobel meta sensitization is typically carried out by gold sensitization using gold compounds, typically gold complex salts. Complex salts of nobel metals other than gold, e.g., platinum, palladium, iridium, etc., may also be used. Specific examples of gold sensitization are described, e.g., in U.S. Pat. No. 2,448,060 and British Pat. No. 618,061.

For the purpose of increasing sensitivity, the light-sensitive materials of the present invention may contain sensitizing dyes, such as cyanine dyes, merocyanine dyes, and the like. In case of using cationic dyes, cyanine dyes, hemicyanine dyes, and rhodacyanine dyes are preferred, and more preferred are those shown below.

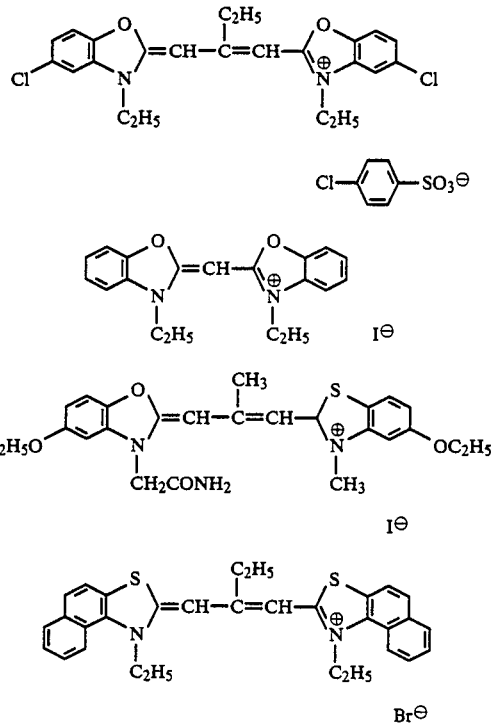

These sensitizing dyes may be used either individually or in combination thereof. Combinations of sensitizing dyes are frequently employed for the particular purpose of supersensitization. The emulsions may further contain, in combination with the sensitizing dyes, dyes which do not per se have spectral sensitizing activity, or substances which do not substantially absorb visible light, but which do show supersensitizing effects. Examples of useful sensitizing dyes, combinations of dyes for supersensitization, and substances producing supersensitizing effects are described in *Research Disclosure,* Vol. 176, RD No. 17643, p. 23, IV-J (December, 1978).

The light-sensitive materials according to the present invention can contain various compounds for the purpose of preventing fog during preparation, preservation before use, or photographic processing of the light-sensitive materials, or for stabilizing photographic performances. Such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, e.g., oxazolinethione, etc.; azaindenes, e.g., triazaindenes, tetraazaindenes (particularly 4-hydroxy-substituted (1,3,3a,7)tetraazaindenes), pentaazaindenes, etc.; benzenethiosulfonic acid, benzenesulfinic acid, benzenesulfonic acid amide, and varius other compounds known as antifoggants or stabilizers. Preferred among them are benzotriazoles (e.g, 5-methyl-benzotriazole) and nitroindazoles (e.g., 5-nitroindazole). These compounds may be incorporated in a processing solution.

The photographic emulsion layers or any other light-insensitive hydrophilic colloidal layers of the light-sensitive materials of the present invention can further contain organic or inorganic hardener, such as chrominum salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), epoxy compounds (e.g., tetramethyleneglycol diglycidyl ether, etc.), isocyanate compounds (e.g., hexamethylene diisocyanate, etc.), and the like, either alone or in combinations thereof.

The photographic emulsions layers or other hydrophilic colloidal layers can furthermore contain various surface active agents for various purposes, for example as coating aids, as antistatic agents, for improvement of sliding properties, as emulsification and dispersing aids, for prevention of adhesion, for improvement of photographic characteristics (e.g., development acceleration, increase in contrast, and increase in sensitivity), and the like. Examples of useful surface active agents include nonionic surface active agents, such as saponine (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or alkylamides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugars, etc.; anionic surface active agents containing an acid group (e.g., carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Surface active agents that are particularly preferred in the present invention are polyalkylene oxides havin molecular weights of 600 or more as described in U.S. Pat. No. 4,221,857. For use as antistatic agents, fluorine-containing surface active agents are suitable. In order to improve dimensional stability, polymer latices of polyalkyl acrylates, etc., may be added.

Photographic characteristics showing super-high contrast and high sensitivity can be obtained from the silver halide light-sensitive materials according to the present invention by using a stable developing solution without requiring any special developing solutions, such as conventional infectious developers and highly alkaline developers at a pH near 13 as described in U.S. Pat. No. 2,419,975.

That is, the silver halide light-sensitive materials of the present invention can be developed with a developing solution containing generally not less than 0.15 mol/l, and preferably from 0.2 to 0.8 mol/l, of a sulfite ion as a preservative and having a pH value of generally from 10.5 to 12.3, and particularly from 11.0 to 12.0 thereby to obtain a negative image having a sufficiently high contrast.

Developing agents which can be used in the developing solution are not particularly limited, and include dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), and mixtures thereof.

The silver halide light-sensitive materials of the present invention are particularly suitable for development processing with a developing solution containing dihydroxybenzenes as a main developing agent and 3-pyrazolidones or aminophenols as auxiliary developing agent. Such a developing solution preferably contains from 0.05 to 0.5 mol/l (developing solution), and particularly from 0.15 to 0.45 mol/l, of the dihydroxybenzene and not more than 0.06 mol/l (developing solution), and particularly from $0.5\times10^{-3}$ to 0.02 mol/l, of the 3-pyrazolidone or aminophenol.

The rate of development can be increased to realize reduction of development time by adding amines to a developing solution as described in U.S. Pat. No. 4,269,929.

The developing solution can further contain pH buffering agents, such as sulfites, carbonates, borates, and phosphates of alkali metals; development restrainers or antifoggants, such as bromides, iodides, and organic antifoggants (preferably nitroindazoles or benzotriazoles); and the like. If desired, the developing solution may furthermore contain water softeners, dissolution aids, color toning agents, development accelerators, surface active agents (preferably the above-described polyalkylene oxides), defoaming agents, hardeners, silver stain inhibitors (e.g., 2-mercaptobenzimidazole sulfonates), and the like.

In particular, the silver stain inhibitors that can be used include the compounds described in Japanese Patent Application (OPI) No. 24347/81. Dissolution aids that can be used include the compounds described in Japanese Patent Application (OPI) No. 267759/86. The pH buffering agents to be used include the compounds described in Japanese Patent Application (OPI) No. 93433/85 and Japanese Patent Application No. 28708/86.

A fixing solution which can be used in the present invention has a commonly employed composition. Fixing agents to be used include thiosulfates, thiocyanates, and other organic sulfur compounds known to have fixing effects. The fixing solution may contain water-soluble aluminum salts as hardeners.

The processing temperature in the present invention is usually selected from a range of from 18° to 50° C.

The present invention is further described below in greater detail by reference to the following examples, but it is to be understood that the present invention is not limited thereto.

EXAMPLE 1

A silver nitrate aqueous solution and an aqeous solution containing potassium bromide and potassium iodide were mixed in the presence of ammonia while maintaining a pAg value of 7.9 according to a double jet process to obtain a monodisperse emulsion of silver iodobromide having a mean grain size of 0.2 μm, (silver iodide content: 2 mol%; silver bromide content: 98 mol%). The resulting emulsion was designated as Emulsion A.

Separately, a silver nitrate aqueous solution and a potassium bromide aqueous solution were mixed in the presence of ammonia while maintaining a pAg value of 7.9 according to a double jet process to prepare a monodisperse emulsion of silver bromide having a mean grain size of 0.35 μm. The resulting emulsion was designated as Emulsion B.

Emulsion A was subjected to sulfur sensitization using sodium thiosulfate.

Both Emulsions A and B were spectrally sensitized using 5,5'-dichloro-3,3'-di(3-sulfopropyl)-9-ethyloxacarbocyanine sodium salt in amounts of $6\times10^{-4}$ mol and $4.5\times10^{-4}$ mol, respectively, per mol of silver.

Both Emulsions A and B further contained 4-hydroxy-6-methyl-1,3,3a,7-tetraazaindene as a stabilizer.

Emulsions A and B were mixed at such a ratio that a weight ratio of silver halide was 6/4. To the mixed emulsion were added an acidic polyer latex and a hydrophobic polymer latex as indicated in Table 1, $4\times10^{-3}$ mol/l of a hydrazine derivative of formula

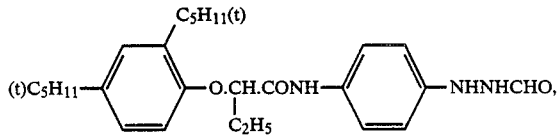

an alkylbenzenesulfonate as a surface active agent, and a vinylsulfonic acid type hardener. After adjusting the emulsion to a pH of 5.8, the emulsion was coated on a 100 μm thick polyethylene terephthalate support to a silver coverage of 3.0 g/m². Gelatin was then coated thereon to a coverage of 1 g/m² to prepare Samples (1) to (17) as shown in Table 1.

Each of these samples was wedgewise exposed to light for sensitometry for 5 seconds using a 3,200° K. tungsten lamp (color temperature: 3200° K.). The exposed sample was then developed with a developing solution having the following formulation at 38° C. for 30 seconds, fixed, washed with water, and dried. An automatic developing machine ("FG-660F" manufactured by Fuji Photo Film Co., Ltd.) was used for development processing.

| Formulation of Developing Solution: | |
|---|---|
| Hydroquinone | 45.0 g |
| N—Methyl-p-aminophenol hemisulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyl diethanolamine | 15.0 g |
| Water to make | 1000 ml |

-continued

| Formulation of Developing Solution: |
|---|
| pH = 11.6 |

The thus processed samples were evaluated for black spots, relative sensitivity, maximum blackening density ($D_{max}$), and gamma ($\gamma$).

The relative sensitivity was expressed in a relative value of an exposure (E) that gives a density of 1.5 ($\Delta$ log E) taking the sensitivity of Sample d as a standard. The gamma was a gradient of a line connecting density 0.3 and density 3.0 of a characteristic curve.

Evaluation of black spots was made as follows. The sample was developed at 38° C. for 30 seconds using a developing solution having the same formulation as used above except for having a pH increased by about 0.2 with granular sodium hydroxide, followed by fixing and washing. After drying, the highlight portion was microscopically observed at a magnification of 2.5. The number of black spots in the area corresponding to a diameter of about 4 mm was counted.

The results of these evaluations are shown in Table 1 below.

TABLE 1

| Sample No. | Acidic Polymer Latex Compound | Acidic Polymer Latex Amount Added ($g/m^2$) | Hydrophobic Polymer Latex Compound | Hydrophobic Polymer Latex Amount Added ($g/m^2$) | Black Spots | Relative Sensitivity | $D_{max}$ | Gamma ($\gamma$) |
|---|---|---|---|---|---|---|---|---|
| a* | II-1 | 0.4 | — | — | 39 | −0.12 | 4.74 | 15.0 |
| b* | " | 0.8 | — | — | 22 | −0.18 | 4.62 | 14.2 |
| c* | — | — | III-1 | 0.4 | 104 | +0.07 | 4.57 | 15.9 |
| d* | — | — | " | 0.8 | 55 | 0(standard) | 4.50 | 13.5 |
| 1 | II-1 | 0.4 | " | 0.4 | 13 | −0.15 | 4.61 | 14.2 |
| 2 | " | " | III-2 | " | 15 | −0.12 | 4.55 | 14.5 |
| 3 | " | " | III-3 | " | 8 | −0.17 | 4.59 | 14.4 |
| 4 | " | " | III-4 | " | 17 | −0.14 | 4.48 | 14.7 |
| 5 | " | " | III-5 | " | " | −0.12 | 4.60 | 14.6 |
| 6 | " | " | III-10 | " | 15 | −0.13 | 4.57 | 14.3 |
| 7 | " | " | III-12 | " | 10 | −0.11 | 4.65 | 14.5 |
| 8 | " | " | III-18 | " | 7 | −0.13 | 4.63 | 15.3 |
| 9 | " | " | III-19 | " | 9 | −0.15 | 4.55 | 15.0 |
| 10 | " | " | III-20 | " | 7 | −0.13 | 4.61 | 15.1 |
| 11 | " | " | III-21 | " | 10 | −0.15 | 4.59 | 14.9 |
| 12 | II-2 | " | III-1 | " | 15 | −0.17 | 4.56 | 14.0 |
| 13 | II-3 | " | " | " | 17 | −0.14 | 4.55 | 14.4 |
| 14 | II-4 | " | " | " | 14 | −0.15 | 4.60 | 14.3 |
| 15 | II-5 | " | III-18 | " | 10 | −0.12 | 4.65 | 14.8 |
| 16 | II-7 | " | " | " | 9 | −0.17 | 4.63 | 14.5 |
| 17 | II-1 | " | III-23 | " | 13 | −0.15 | 4.65 | 14.5 |

Note:
*comparative sample

As can be seen from Table 1, formation of black spots is markedly suppressed by the combined use of the acidic polymer latex and hydrophobic polymer latex according to the present invention.

EXAMPLE 2

Sample b (comparison) and Sample 1 (Invention) as prepared in Example 1 were subjected to an accelerated aging test under various conditions as shown in Table 2. The samples were then processed in the same manner as described in Example 1, and changes in photographic characteristics were examined.

TABLE 2

| Sample No. | Aging Condition | Relative Sensitivity | $D_{max}$ | Gamma |
|---|---|---|---|---|
| b | — | −0.18 | 4.62 | 14.2 |
| | 50° C., 30% RH, 3 days | −0.20 | 4.55 | " |
| | 50° C., 65% RH, 3 days | −0.25 | 4.28 | 13.6 |
| | 50° C., 75% RH, 3 days | −0.38 | 4.01 | 12.3 |
| 1 | — | −0.15 | 4.61 | 14.2 |
| | 50° C., 30% RH, 3 days | −0.13 | 4.70 | 15.4 |
| | 50° C., 65% RH, 3 days | −0.15 | 4.56 | 14.2 |
| | 50° C., 75% RH, 3 days | −0.24 | 4.31 | 14.0 |

As can be seen from Table 2, Sample 1 according to the present invention undergoes less deterioration in sensitivity, $D_{max}$, and gamma when subjected to accelerated aging.

EXAMPLE 3

Coating compositions having the same formulations as used for Samples b (comparison) and 1 (Invention) of Example 1 except for containing no hardener were kept at 40° C. for 8 hours while gently stirring. When each of the compositions was passed through a filter (pore size: 10 $\mu$m), the composition for Sample 1 was filtered smoothly with no precipitate on the filter, whereas the composition for Sample b left a precipitate on the filter, which was found by infrared spectrography to mainly comprise the hydrazine derivative added.

As described above, a combined use of the polymer latices according to the present invention is effective to improve stability of a hydrazine derivative in the coating composition.

While the invention has been described in detail and with reference to specific embodiments thereof, it will be apparent to one skilled in the art that various changes and modifications can be made therein without departing from the spirit and scope thereof.

What is claimed is:

1. A super-high contrast negative type silver halide photographic material comprising a support having provided thereon at least one silver halide emulsion layer, said emulsion layer or layers or other hydrophilic colloidal layer or layers containing a hydrazine derivative, wherein said photographic material further contains (a) an acidic polymer incorporating not less than 20 mol% of a monomer unit containing an acid group and a crosslinkable monomer unit containing at least two copolymerizable ethylenically unsaturated groups, (b) a hydrophobic polymer incorporating not more than 20 mol% of a monomer unit containing an acid group and having a glass transition temperature of not more than 50° C.

2. A super-high contrast negative type silver halide photographic material as in claim 1, wherein said hydrazine derivative is represented by formula (I)

$$R_1\text{—NHNH—CHO} \qquad \text{(I)}$$

wherein $R_1$ represents an aliphatic group, or an aromatic or heterocyclic group.

3. A super-high contrast negative type silver halide photographic material as in claim 2, wherein $R_1$ represents an aryl group.

4. A super-high contrast negative type silver halide photographic material as in claim 1, wherein said hydrazine derivative is present in a silver halide emulsion layer.

5. A super-high contrast negative type silver halide photographic material as in claim 1, wherein said hydrazine derivative is present in an amount of from $1\times10^{-6}$ to $1\times10^{-1}$ mol per mol of silver halide.

6. A super-high contrast negative type silver halide photographic material as in claim 1, wherein said acidic polymer incorporating not less than 20 mol% of a monomer unit containing an acid group having a pKa value of 9 or less.

7. A super-high contrast negative type silver halide photographic material as in claim 6, wherein said acid group is a carboxyl group, a sulfoxylic acid group, or a phosphoric acid group.

8. A super-high contrast negative type silver halide photographic material as in claim 1, wherein said acidic polymer is in the form of an aqueous latex.

9. A super-high contrast negative type silver halide photographic material as in claim 1, wherein said monomer unit containing an acid group is a copolymerizable ethylenically unsaturated monomer represented by formula (II)

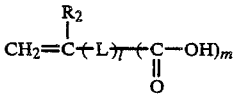

(II)

wherein $R_2$ represents a hydrogen atom or a substituted or unsubstituted alkyl group; L represents a di- to tetravalent linking group; l represents 0 or 1; and m represents 1, 2, or 3.

10. A super-high contrast negative type silver halide photographic material as in claim 9, wherein $R_2$ represents a hydrogen atom, a methyl group, or a carboxymethyl group; and L represents —Q—,

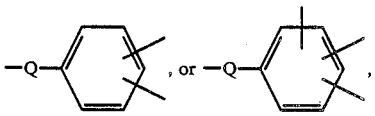

wherein Q represents a divalent linking group.

11. A super-high contrast negative type silver halide photographic material as in claim 1, wherein said acidic polymer incorporates from 20 to 90 mol% of said monomer unit containing an acid group and from 1 to 50 mol% of said crosslinkable monomer.

12. A super-high contrast negative type silver halide photographic material as in claim 1, wherein said acidic polymer incorporates from 50 to 90 mol% of said monomer unit containing an acid group and from 10 to 30 mol% of said crosslinkable monomer.

13. A super-high contrast negative type silver halide photographic material as in claim 1, wherein said acidic polymer is prepared in the presence of a persulfate as a polymerization initiator.

14. A super-high contrast negative type silver halide photographic material as in claim 1, wherein said acidic polymer is prepared at a polymerization temperature of from 90° to 98° C.

15. A super-high contrast negative type silver halide photographic material as in claim 8, wherein said aqueous polymer latex has a pH of from 3.5 to 5.0.

16. A super-high contrast negative type silver halide photographic material as in claim 1, wherein said hydrophobic polymer incorporates a monomer unit represented by formula (III)

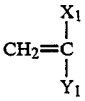

(III)

wherein $X_1$ represents a hydrogen atom, a halogen atom, a cyano group, or a substituted or unsubstituted alkyl group; and $Y_1$ represents a hydrogen atom, a halogen atom, a cyano group, a substituted or unsubstituted alkyl group,

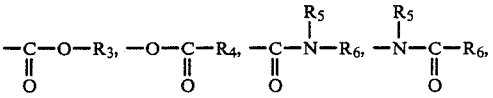

or a substituted or unsubstituted aryl group, wherein $R_3$ and $R_4$ each represents a substituted or unsubstituted alkyl group or a substituted or unsubstituted aryl group; and $R_5$ and $R_6$ each represents a hydrogen atom, a substituted or unsubstituted alkyl group, or a substituted or unsubstituted aryl group.

17. A super-high contrast negative type silver halide photographic material as in claim 16, wherein $X_1$ represents a substituted or unsubstituted alkyl group having from 1 to 4 carbon atoms; and $Y_1$ represents

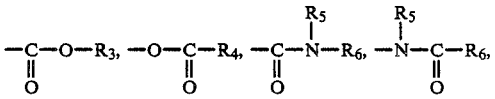

or a styrene group, wherein $R_3$ and $R_4$ each represents a substituted or unsubstituted alkyl group; and $R_5$ and $R_6$ each represents a hydrogen atom or a substituted or unsubstituted alkyl group.

18. A super-high contrast negative type silver halide photographic material as in claim 17, wherein $Y_1$ represents

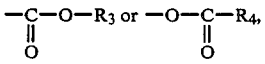

wherein $R_3$ represents a substituted or unsubstituted alkyl group having from 2 to 6 carbon atoms; and $R_4$ represents a substituted or unsubstituted alkyl group having from 1 to 6 carbon atoms.

19. A super-high contrast negative type silver halide photographic material as in claim 1, wherein said hydrophobic polymer is in the form of an aqueous latex.

20. A super-high contrast negative type silver halide photographic material as in claim 8, wherein said acidic polymer latex is present in an amount of from 0.05 to 2.0 $g/m^2$.

21. A super-high contrast negative type silver halide photographic material as in claim 8, wherein said acidic polymer latex is present in an amount of from 0.1 to 1.0 $g/m^2$.

22. A super-high contrast negative type silver halide photographic material as in claim 19, wherein said hydrophobic polymer latex is present in an amount of from 0.1 to 3.0 $g/m^2$.

23. A super-high contrast negative type silver halide photographic material as in claim 19, wherein said hydrophobic polymer latex is present in an amount of from 0.2 to 1.5 $g/m^2$.

* * * * *